United States Patent [19]

Chuang

[11] Patent Number: 5,050,876

[45] Date of Patent: Sep. 24, 1991

[54] MAGNETIC FISHING TOY

[76] Inventor: Chuan-Tien Chuang, No. 40, Lane 174, Ta Hsing Street, Tainan, Taiwan

[21] Appl. No.: 641,959

[22] Filed: Jan. 16, 1991

[51] Int. Cl.[5] ..... A63F 9/00

[52] U.S. Cl. ..... 273/456; 40/426; 446/134

[58] Field of Search ..... 273/1 G D, 1 G C, 140; 446/129, 131, 134, 135, 136; 40/426

[56] References Cited

U.S. PATENT DOCUMENTS

| | | | |
|---|---|---|---|
| 622,545 | 4/1899 | Schoknecht et al. | 273/140 X |
| 1,947,920 | 2/1934 | Primrose | 446/134 |
| 4,432,544 | 2/1984 | Wakimura | 446/136 X |
| 4,578,044 | 3/1986 | Saitoh | 446/134 |

*Primary Examiner*—Paul E. Shapiro
*Attorney, Agent, or Firm*—Varndell Legal Group

[57] ABSTRACT

A fishing toy being magnetic, differently constructed and simplified in structure is provided. The toy includes a base plate mounting thereon rotating magnetic pieces, a vessel containing therein buoied fishes each of which connects thereto a connecting line, and a housing having recesses respectively disposing therein magnetic counterparts each of which will rotate when the respective magnetic piece rotates and secures thereto the connecting line in the manner that when rotated, each magnetic counterpart can repeatedly wind therearound and unwind therefrom the connecting line.

4 Claims, 4 Drawing Sheets

MAGNETIC FISHING TOY

BACKGROUND OF THE INVENTION

The present invention relates to a toy, and more particularly to a fishing toy.

Conventionally fishing toys always include a rotating disk having holes receiving therein toy fish in order that when the disk is energized to rotate, the toy fish intermittently opening and closing their mouths and vertically moving can be fished by a fishing rod. Such toys suffer from the disadvantage that no matter how the rotating disk, the toy fish and the related structure are skillfully designed, the toy fish can only move in the relatively extremely small hole in the rotating disk so that such toys are relatively dull in some respect.

SUMMARY OF THE INVENTION

It is therefore an object of the present invention to provide a magnetic fishing toy having a toy fish capable of moving at a relatively large space.

It is further an object of the present invention to provide a magnetic fishing toy having a simplified structure.

According to the present invention, a magnetic fishing toy includes a base plate mounting thereon a plurality of rotating magnetic pieces, a vessel, containing therein buoied fishes each of which connects thereto a connecting line, and a housing having recesses respectively disposing therein magnetic counterparts each of which will rotate when the respective magnetic piece rotates and secures thereto the respective connecting line in the manner that when rotated, the magnetic counterpart can repeatedly wind therearound and unwind therefrom the connecting line.

The present invention may best be understood through the following description with reference to the accompanying drawings, in which:

DETAILED DESCRIPTION OF THE PREFERRED EMBODIMENT

Figure 1:
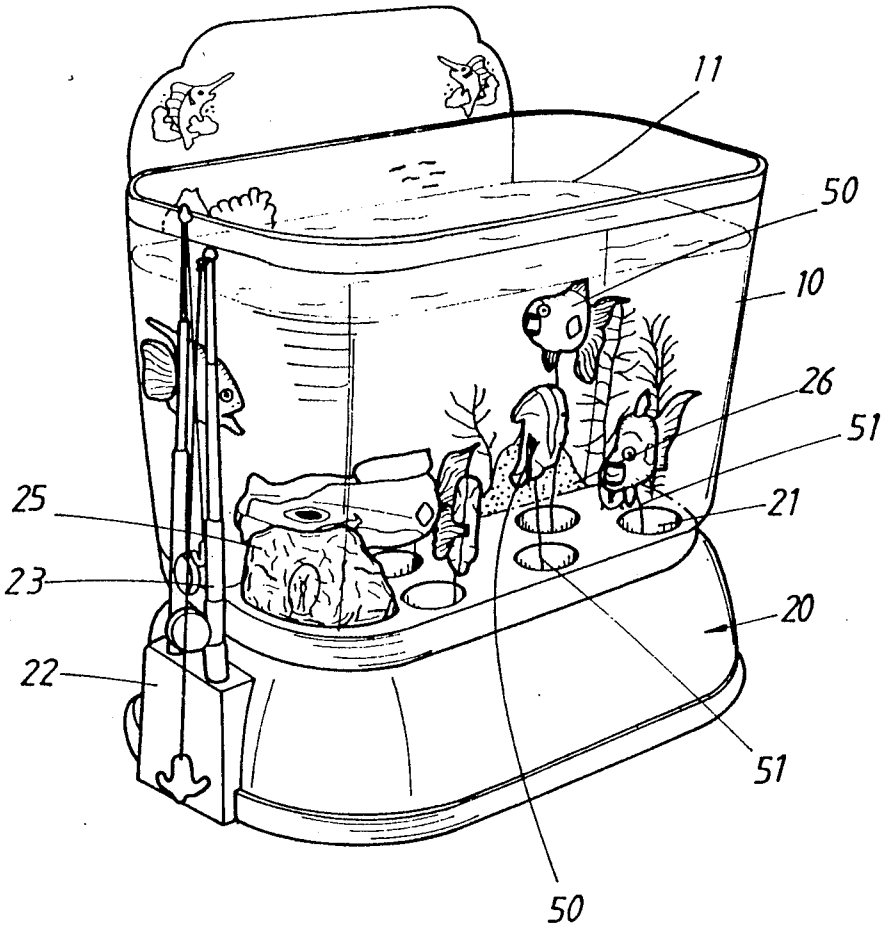
FIG. 1 is a perspective view showing a preferred embodiment of a magnetic fishing toy according to the present invention.
Figure 2:
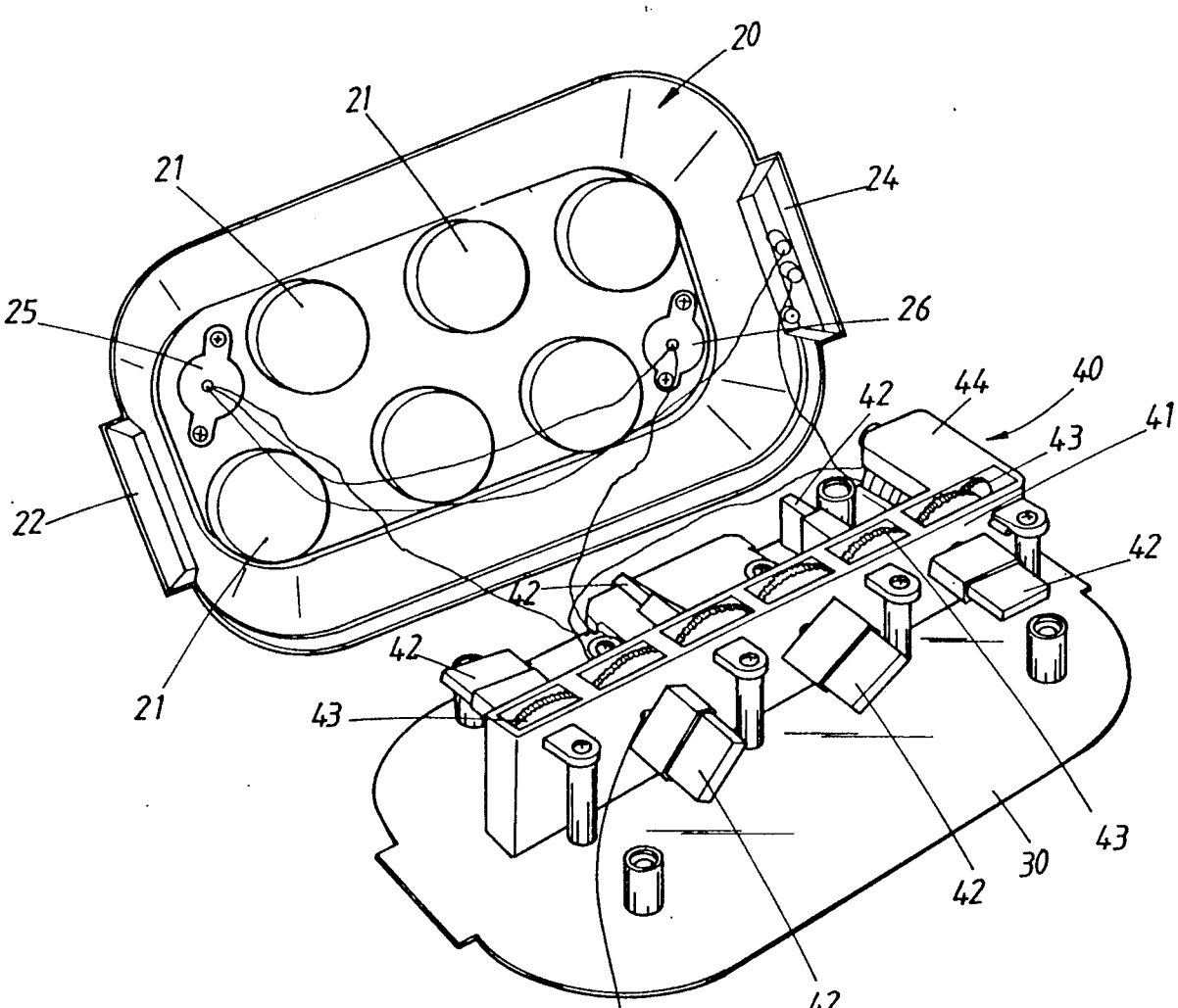
FIG. 2 is an exploded view showing a housing and a base plate of a magnetic fishing toy in FIG. 1.
Figure 3:
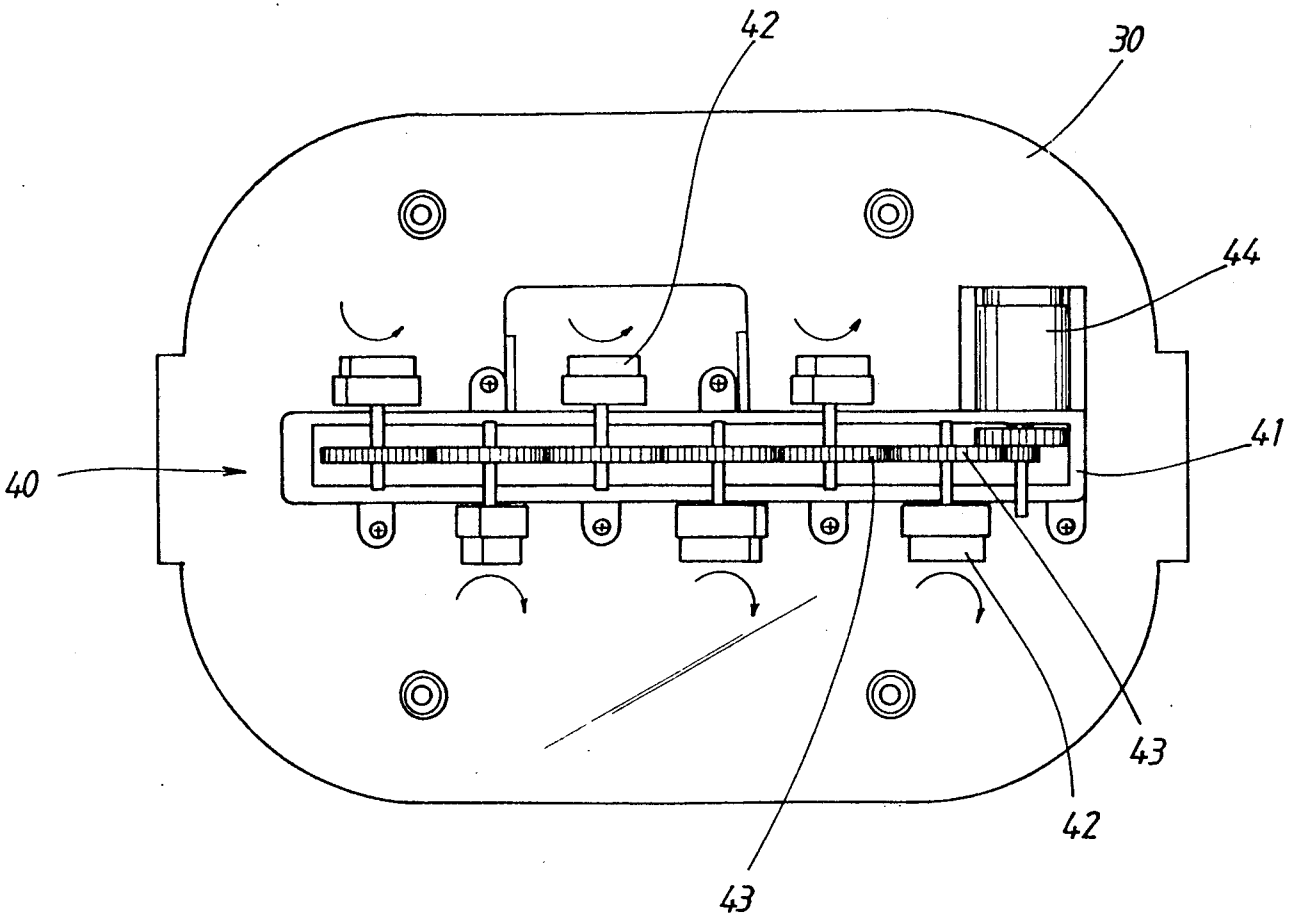
FIG. 3 is a top view showing a base plate in FIG. 2.
Figure 4:
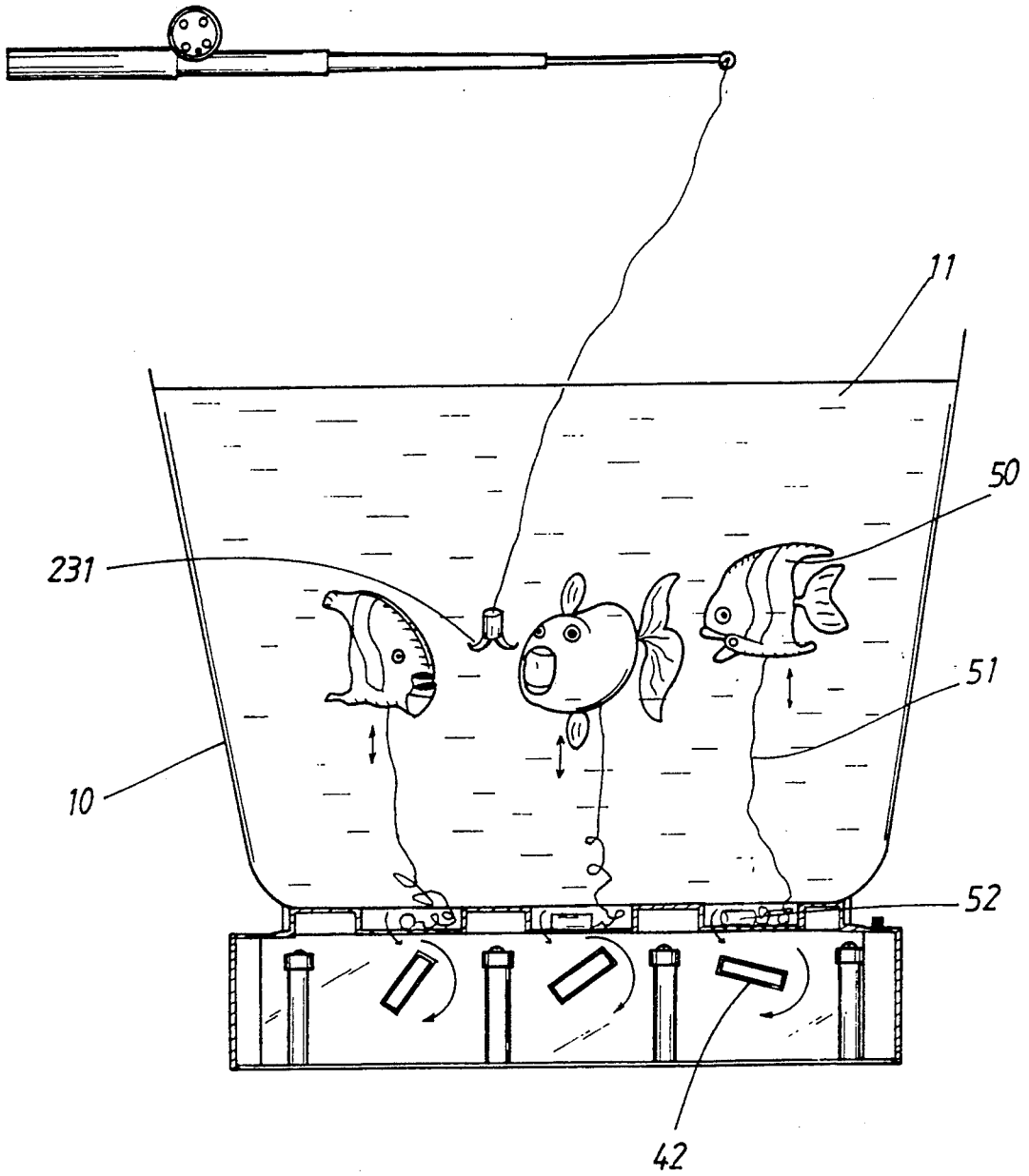
FIG. 4 is a schematically sectional view showing a magnetic fishing toy in FIG. 1.

Referring now to FIGS. 1–4, a preferred embodiment of a magnetic fishing toy according to the present invention includes an aquarium-shaped vessel 10 containing therein a liquid 11, a base plate 30 and a housing 20 positioned between vessel 10 and base plate 30. Housing 20 serving as the bottom of vessel 10 includes a plurality of recesses 21, a first side piece 22 for inserting thereon fishing rods 23, a second side piece 24 serving as a control panel, and two oppositely disposed transparent pieces 25, 26 for mounting therein illuminating devices.

An operating mechanism 40 mounted on base plate 30 includes a central wall 41 alignedly mounting therein a plurality of meshing gears 43 which are driven by a motor 44 and respectively have the shafts 45 thereof secured to a plurality of magnetic pieces 42 respectively positioned beneath recesses 21.

The toy fish 50 can be kinds of fishes and should have a length larger than the diameter of recesses 21 so that any fish 50 cannot be received in the respective recess 21. A connecting line 51 respectively has two ends thereof connected to a fish 50 and a cylindrical magnetic counterpart 52 which is disposed in a respective recess 21 and will rotate when the respective magnetic piece 42 rotates. Each fish 50 has a mouth capable of matching therein a hook 231 of fishing rod 23.

After motor 44 is energized, the rotated gears 43 will respectively rotate mangetic pieces 42 by which magnetic counterparts 52 are respectively rotated accordingly in responsive to the rotating magnetic poles of magnetic pieces 42 so that the magnetic counterpart 52 will wind therearound the respective connecting line 51 to sink the respective toy fish 50. When the toy fish 50 is stopped by the shoulder surface of the respective recess 21, the continuing rotation of the magnetic counterpart 52 will eventually allow the connecting line 51 to unwind from the magnetic counterpart 52 so that the floating force generated by liquid 11 against the toy fish 50 will upwardly buoy the toy fish 50 ready to be caused to sink by the wound connecting line 51 again. Thus, to fish the toy fish in the fishing toy is made more difficult and funnier.

Through the above description, it should now become readily apparent how and why the present invention can achieve the objects it contemplates. It is also to be understood that the above disclosed embodiment is illustrative but not limitative.

I claim:

1. A magnetic fishing toy comprising:

a base plate mounting thereon a plurality of rotating magnetic pieces;

a vessel capable of containing therein a buoying fluid capable of buoying therein/thereon a plurality of fish/fishes each of which has a mouth and connects thereto a connecting line; and a housing positioned between said base plate and said vessel, and including a plurality of recesses respectively incapable of receiving therein said fish/fishes and respectively disposing therein a plurality of magnetic counterparts each of which will rotate when a respective said magnetic piece rotates and is capable of securing thereto said connecting line in a manner that when rotated, said each magnetic counterpart can repeatedly wind therearound and unwind therefrom said connecting line.

2. A magnetic fishing toy according to claim 1 wherein said housing serves as a bottom of said vessel.

3. A magnetic fishing toy according to claim 1 wtherein said base includes a central wall alignedly mounting therein a plurality of meshing gears having shafts respectively securing thereto said magnetic pieces.

4. A magnetic fishing toy according to claim 1 wherein said magnetic counterparts are cylinder-shaped.

* * * * *